US005517933A

United States Patent [19]

Karaba, Jr.

[11] Patent Number: 5,517,933

[45] **Date of Patent: * May 21, 1996**

[54] COVER THREAD ASSIST MEMBER

[75] Inventor: James M. Karaba, Jr., Rockford, Ill.

[73] Assignee: Union Special Corporation, Huntley, Ill.

[ * ] Notice: The portion of the term of this patent subsequent to Dec. 19, 2014, has been disclaimed.

[21] Appl. No.: 184,242

[22] Filed: Jan. 19, 1994

Related U.S. Application Data

[63] Continuation-in-part of Ser. No. 63,096, May 17, 1993, Pat. No. 5,383,414.

[51] Int. Cl.[6] ..... D05B 1/10

[52] U.S. Cl. ..... 112/475.26; 112/166; 112/199

[58] Field of Search ..... 112/100, 162, 112/163, 165, 166, 167, 269.1, 197, 199, 200, 475.26

[56] References Cited

U.S. PATENT DOCUMENTS

| | | | |
|---|---|---|---|
| 3,776,157 | 12/1973 | Szostak . | |
| 4,117,792 | 10/1978 | Navlyt . | |
| 4,175,499 | 11/1979 | Navlyt . | |
| 4,917,032 | 4/1990 | Matsumoto . | |
| 5,383,414 | 1/1995 | Winter et al. | 112/100 X |

FOREIGN PATENT DOCUMENTS

| | | |
|---|---|---|
| 510149 | 10/1930 | Germany . |
| 3346813C2 | 6/1984 | Germany . |
| 3639390C2 | 2/1987 | Germany . |
| 4000747C1 | 1/1990 | Germany . |
| 292872 | 6/1928 | United Kingdom . |
| 294824 | 10/1928 | United Kingdom . |
| 610365 | 10/1948 | United Kingdom . |
| 709531 | 5/1954 | United Kingdom . |

*Primary Examiner*—Paul C. Lewis
*Attorney, Agent, or Firm*—Willian Brinks Hofer Gilson & Lione

[57] ABSTRACT

A mechanism and method for forming a facing seam at a relatively high rate that will insure that the cover thread is properly interwoven between each stitch of two parallel rows of stitches. The facing seam is formed by two needles and cooperating loopers for forming two parallel rows of stitches that are joined by a cover thread that lies on the upper surface of the work piece. The cover thread is controlled by a conventional spreader and a cover thread assist member. The cover thread assist member is formed from a lightweight hardened wire that is fixed to a mid portion of the conventional spreader.

26 Claims, 4 Drawing Sheets

64
84
86
78
80
168
70
76
136
88
90
92
94
96
98
100
102
104
106
107
108
110
114
120
122
124
126
130
132
134
138

COVER THREAD ASSIST MEMBER

CROSS-REFERENCE

The present application is a Continuation-in-Part application of Ser. No. 08/063,096 filed on May 17, 1993 that issued on Jan. 24, 1995 as U.S. Pat. No. 5,383,414, entitled APPARATUS FOR MAKING A THREE NEEDLE STITCH WITH COVER THREAD.

BACKGROUND OF THE INVENTION

This invention relates to a device that will prevent skipping of the cover thread when forming a facing seam at high stitch rates. Skipping of the cover thread occurs when the cover thread is not on the proper side of the needle when the needle penetrates the workpiece. The invention also relates to an improved method of forming a facing seam at high stitch rates that will prevent the cover thread from skipping. The new device and method is useful in many applications including a pocket facing application.

This invention has particular application in the pocket facing operation on bluejeans. In this operation an upper layer or ply of denim is stitched, along a raw edge of the denim, to a pocket fabric ply.

In the prior art a pocket facing operation is performed by applying a modified 602 stitch that has two parallel rows of standard Type 401 stitches with a top cover thread interlaced between the two rows of Type 401 stitches. In this prior art pocket facing operation, the stitch extends straight for a short distance, then follows a radius for about 90° and then extends straight for another short distance. The cover thread when properly applied is in front of the left needle and behind the right needle when the needles penetrate the fabric. The cover thread sometimes is not properly located with respect to the needle penetration points and skips one or more stitches. This problem occurs most frequently when sewing at high speeds and or when sewing a non-straight line pattern. The prior art pocket facing operation is started in the area where the stitch pattern is straight, with the right needle at the raw edge of the upper ply of material. As the stitch is formed around the radius, the cover thread sometimes skips a stitch or more, leaving the lines of Type 401 stitches unconnected and the raw edge of the upper ply of material is left uncovered by the facing stitch. As the garment is worn and washed the uncovered raw edge unravels and becomes unsightly.

SUMMARY OF THE INVENTION

In accordance with the present invention there is provided a device for forming and a method of forming a stitch for securing together two superimposed workpieces along a raw edge of one of the workpieces that will not skip stitches and thus produces a row of superior stitches that has fewer skipped stitches than produced by the prior art devices and methods. The stitch comprises two continuous upper needle threads, two lower looper threads and a cover thread. Corresponding upper needle and lower looper threads form two parallel rows of standard Type 401 stitches. The cover thread lies along the upper surface of the fabric and is interwoven between, without skips, and connects the two rows of Type 401 stitches. When using this stitch in a pocket facing operation the row of Type 401 stitch to the right is applied to the right of the raw edge of the upper ply of fabric so that the stitch covers the raw edge of the fabric.

The two needles lie in a vertical plane which is at an acute angle to the direction of material feed such that the right needle leads the left needle. The point of the right needles is about ⅛ of an inch above the point of the left needle. The two thread carrying needles introduce first and second continuous needle threads through the workpiece. The respective needle threads are formed into first and second needle thread loops which are formed on the underside of the workpiece. Two oscillating thread carrying loopers interlock looper threads with the first and second needle loops for securing the latter in the workpiece thereby uniting or joining the superimposed workpieces. The point of the right needle is disposed in a horizontal plane that is above the horizontal plane of the point of the left needle. The staggered arrangement of the needle points is compensated for by arranging the oscillating loopers at levels corresponding to the needle points.

A standard spreader, a cover thread assist member, a cover thread eyelet and a cover thread guide are coordinated to lay a cover thread on the top surface of the workpiece plies. In this operation, the cover thread interweaves between the two rows of the 401 Type stitch and thus covers the raw edge of the upper ply.

The new cover thread assist member of this invention functions to insure that the cover thread is correctly laid upon the surface of the work material and interlocked with the two rows of 401 Type stitches and eliminates or reduces skipped stitches.

DETAILED DESCRIPTION OF THE PREFERRED EMBODIMENT

Figure 1:
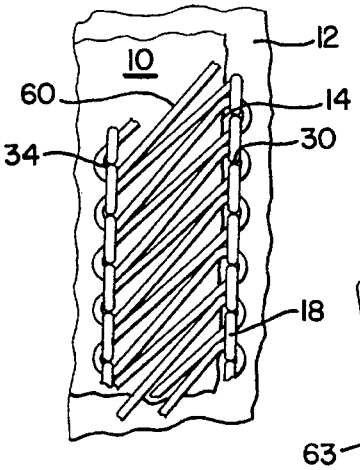
FIG. 1 is a plan view of the stitch applied to overlapping plies of material.

FIG. 1 is a plan view of the stitch of this invention when applied to a workpiece made up of two overlapping plies of material. During the formation of this stitch, the two plies of material to be joined are fed through the machine in overlapping relationship, with the upper ply of material 10 located with its edge 14 extending along a non-edge piece of the lower ply 12. Thus the upper ply of material extends toward the left of its edge 14 and the lower ply 12 extends to the right and the left of edge 14. The stitch spans or covers the edge 14 of the upper ply of material 10 to secure the upper and lower plies and to cover the raw edge 14. When applied to bluejeans, the upper ply 10 is denim material and the lower ply 12 is pocket facing material.

Figure 2:
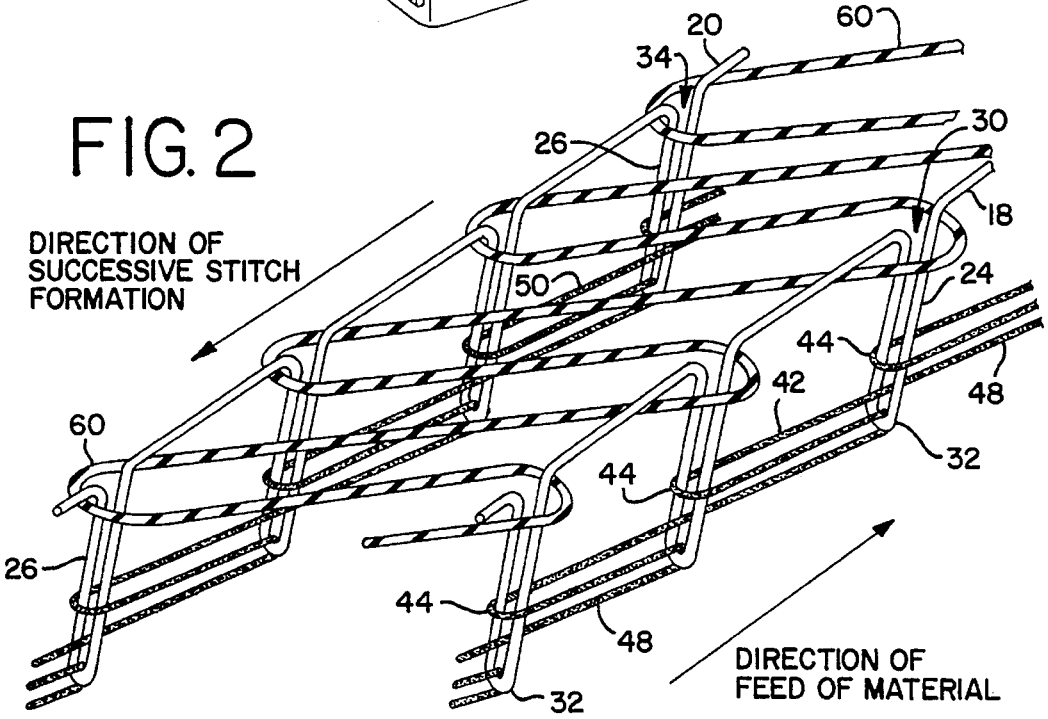
FIG. 2 is a three dimensional rendering of the threads comprising the stitch.

FIG. 2 is a three dimensional illustration of the threads comprising the stitch of this invention. The stitch includes two needle threads 18 and 20, two looper threads 48 and 50 and a cover thread 60. The arrow designated A in this view indicates the Direction of Successive Stitch Formation and the arrow designated B indicates the Direction of Feed of Material. The material plies that are joined by the stitch have not been included in FIG. 2 to better illustrate the stitch formation. The stitch comprises two continuous upper or needle threads 18 and 20 which are formed into right 24 and left 26 loops respectively. The needle threads extend along lines that are laterally offset from each other and generally parallel to the edge 14 of the upper ply of material 10.

Referring now to FIGS. 1 and 2, the right loop 24 of right needle thread 18 passes downwardly from its penetration point 30 through the lower ply 12 of material and extends downwardly to locate the bight portion 32 of the right loop 24 beneath the penetration point 30. The left loop 26 of thread 20 passes downwardly from its penetration point 34 through both the upper ply 10 and the lower ply 12 of material and extends downwardly to locate the bight portion 36 of the left loop 26 beneath the penetration point 34.

A lower right looper thread 48 is formed into a loop 42 that passes through the bight portion 32 of the right loop 24 and as the material is advanced the bight portion 44 of loop 42 is open and below the penetration point 30 of the next successive stitch of the right needle thread 18. Thus the bight portion 44 is penetrated by loop 24 of the next stitch formed by thread 18. The right needle thread 18 and the right looper thread 48 form a standard Type 401 stitch. This first row of Type 401 stitch is formed through only the lower ply 12 of material and follows along the raw edge 14 of the upper ply of material 10. The left needle thread 20 cooperates with left looper threads 50 in the same manner as described above for right needle thread 18 and right looper thread 48 to form a second row of standard Type 401 stitches that extend through both the upper 10 and lower 12 plies of material.

A spreader or cover thread 60 is cast on the upper surface of the superimposed workpieces 10 and 12 and is interlaced between the needle threads 18 and 20 such that it follows a serpentine path and ties the two standard Type 401 stitches together. As the stitch is being sewn, the cover thread 60 must be cast or laid such that it is in front of the left needle 80 and behind the right needle 78 when needles 78 and 80 penetrate the fabric. The terms "behind" and "forward" being relative to the direction that the workpiece is being fed. (See FIGS. 5 and 5*a*) Thus, in the stitch, the cover thread 60 is located behind the penetration point 34 for needle thread 20, and forward of penetration point 30 for needle thread 18. The cover thread pattern ties the two rows of Type 401 stitches together to form a very effective and useful stitch.

Figure 3:
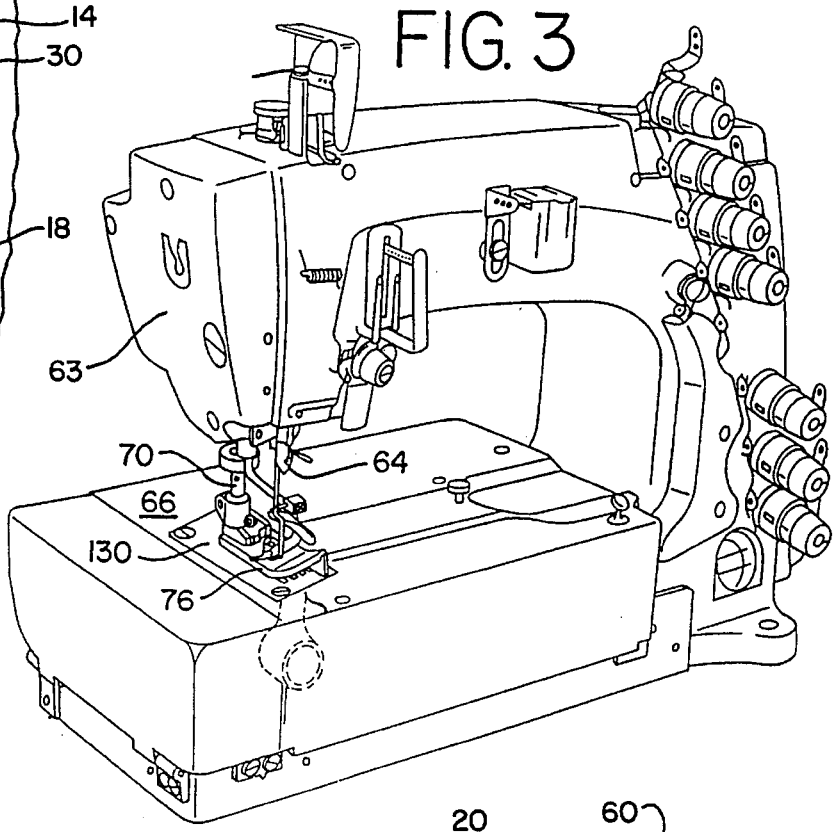
FIG. 3 is a perspective view of a sewing machine of the type that could produce the stitch.

FIG. 3 is a perspective view of a sewing machine 62 of the type that may be used to produce the stitch of this invention. Sewing machine 62 includes a head 63, a work supporting surface 66, a reciprocating needle bar 68 (not shown), a presser foot bar 70 and a throat plate 130. A needle head 64, carrying two needles 78 and 80 (FIG. 5*a*), is secured to the lower end of the needle bar 68 and a presser foot 76 is carried by the lower end of presser foot bar 70. The looper rocker 142 is located below the work supporting surface 66 and is shown in broken lines in this view to depict its relative location in the sewing machine.

Figure 4B:
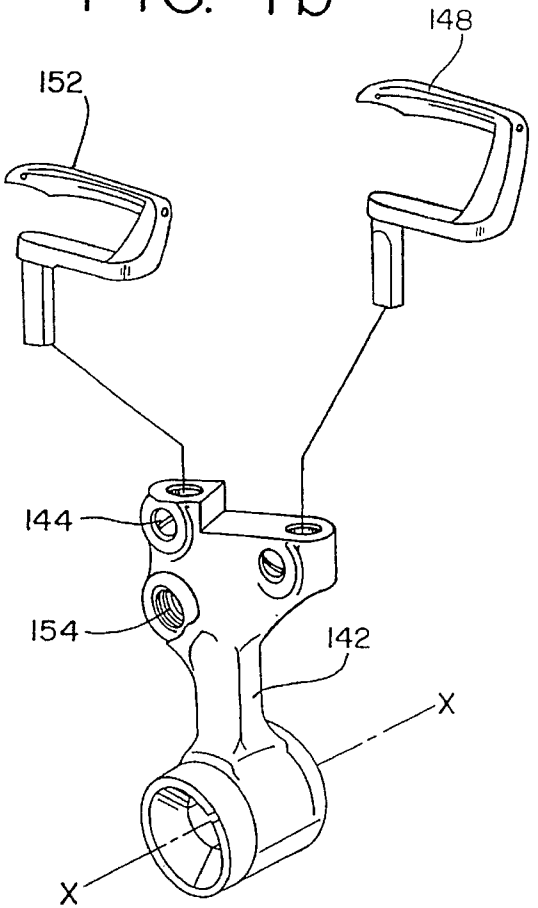
FIG. 4*b* is an isolated perspective view of the looper rocker with the two loopers displaced away from the rocker.
Figure 4A:
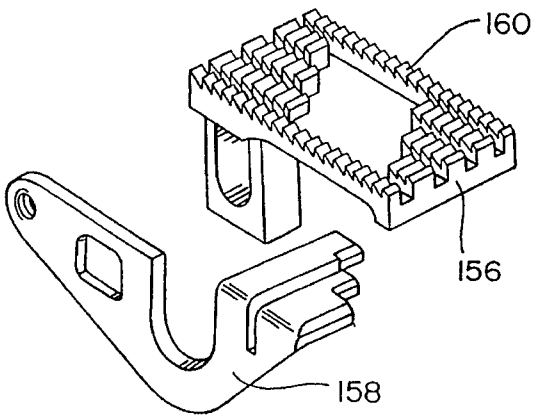
FIG. 4*a* is an isolated perspective view of the feed dog and needle guard.
Figure 4:
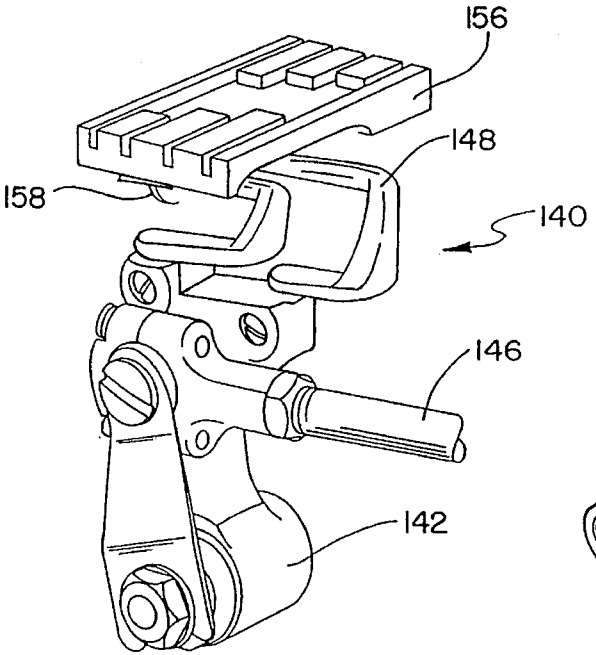
FIG. 4 is a composite view of the oscillating loopers used to produce the stitch.

Referring now to FIGS. 4, 4*a* and 4*b*, a set of loopers 140 is mounted for reciprocal movement below the work supporting surface 66. In FIG. 4 the assembled set of two loopers, right looper 148 and left looper 150 are shown mounted on the looper rocker 142. The loopers 148 and 150 are secured in adjusted position in the looper rocker 142 by set screws 144. Looper 150 is the rear or first looper when looking in the direction of material travel. The loopers are set at a 3/16 inch looper gauge. Looper 148 is the forward or second looper and its point is about 3/16 of an inch to the right of the point of looper 150.

The looper rocker 142 is mounted for oscillating motion on the sewing machine frame about a pivot axis X—X. Conventional looper rockers that have complex motions, such as a rocking motion or an axial motion in addition to an oscillating motion, could also be used. A rocker arm 146 is connected to the looper rocker 142 at threaded bore 154 to impart a rocking or oscillating motion to the looper rocker 142.

FIG. 4*b* shows the looper rocker 142 isolated from the other mechanism with the loopers 148 and 150 removed. It is apparent in this view that the loopers 148 and 150 are staggered from front to back. Looking into the direction of work material feed, the left looper 150 is in the foreground and the right looper 148 is behind the left looper 150.

The sewing needles 78 and 80 are staggered in the direction of the material feed to permit cooperation between each needle and its associated looper during each stitch. (See FIGS. 5 and 5*a*) Thus, the point of right needle 78 is at a level higher than the points of the left needle 80 to cooperate with looper 148 which is at a higher level than looper 150. As a result, the right needle 78 will penetrate the work material after penetration by the left needle 80.

The feed dog 156 in FIG. 4 is located above the set of loopers 140. For simplicity, feed dog 156 is not shown with feed teeth, as in FIG. 4*a*. Also in FIG. 4 a portion of the needle guard 158 is visible.

In FIG. 4*a* the feed dog 156 and the needle guard 158 are shown isolated from the stitch forming mechanism. Feed teeth 160 are located at the top surface of the feed dog 156. The needle guard 158 protects and prevents the needles 78 and 80 from being deflected behind the loopers 148 and 150.

Figures 5, 5A, 5B, 5C, 5D, 5E, 5F:
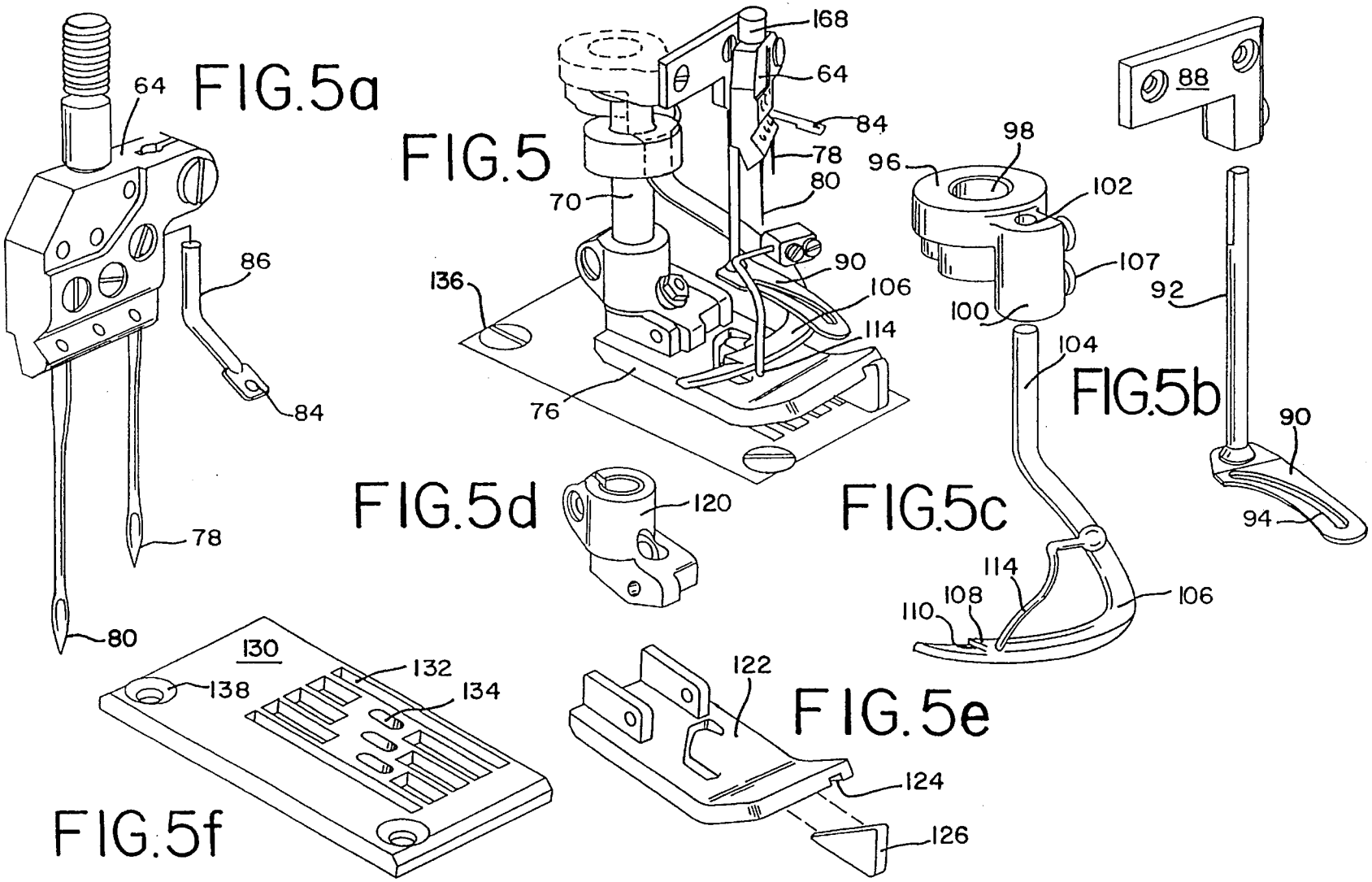
FIG. 5 is a composite view of stitch forming components that are above the work support surface.
FIG. 5*a* is an isolated perspective view of the needle head.
FIG. 5*b* is an isolated perspective view of the cover thread guide and its mounting plate.
FIG. 5*c* is an isolated perspective view of the spreader and cover thread assist member and its holder.
FIG. 5*d* is an isolated perspective view of the presser foot shank.
FIG. 5*e* is an isolated perspective view of the presser foot bottom including the presser foot keel.
FIG. 5*f* is an isolated perspective view of the throat plate.

FIGS. 5, 5*a*, 5*b*, 5*c*, 5*d*, 5*e* and 5*f* illustrate the stitch forming components generally shown in FIG. 3 that are located above the work supporting surface 66. FIG. 5 is a composite view of all these components in assembled condition and FIGS. 5*a* through 5*f* are isolated views of individual components. The needle head 64 carries two needles, right needle 78 and left needle 80. The point of right needle 78 is at a higher elevation than the points of left needle 80. As shown in FIG. 5, the needle head 64 is at an acute angle to the direction of material travel such that right needle 78 is the leading needle and left needle is the trailing needle. A cover thread eyelet 84, through which cover thread 60 passes, is carried at the end of a rod 86 that is adjustably carried by the needle head 64. The cover thread eyelet 84 reciprocates along with the needle bar 68.

As shown seen in FIG. 5*b*, a cover thread guide mounting plate 88 is secured to the sewing head area 72, and functions to mount the cover thread guide 90 at the end of rod 92. The cover thread guide 90 has an elongated arcuate shaped slot 94 formed therein. The cover thread guide 90 remains stationary during the formation of a stitch.

FIG. 5*c* shows a spreader holder 96 having a vertical cylindrical bore 98 which is mounted for oscillation about a bushing (not shown) within the head of the sewing machine. An oscillator (not shown) causes the spreader holder 96 to oscillate. A lug 100 protrudes radially from the spreader holder 96. The lug 100 has a vertical bore 102 that is sized to receive the top end of the spreader mounting bar 104. A pair of set screws 107 is threaded into lug 100 to lock the spreader in a selected position. The spreader 106, is carried at the bottom end of spreader mounting bar 104, and has a generally arcuate shape and lies in a horizontal plane. The spreader 106 has a thread carrying notch 110 including a point 108 formed thereon. The thread carrying notch 110 is useful in casting the cover thread 60 in a serpentine path on the upper surface of the work material.

The spreader 106 serves to mount a cover thread assist member 114. The cover thread assist member 114 comprises a curved wire which extends from a mid portion of spreader 106 toward the spreader point 108. The cover thread assist member 114 terminates approximately at thread carrying notch 110. The cover thread assist member 114 is formed from a hardened wire, having a diameter of 0.048 inches (approximately 0.05 inches) that is secured by silver solder to the spreader 106. The cover thread assist member 114, being formed from a relatively short piece of small diameter wire is light in weight, and thus adds very little to the overall weight of the spreader 106. Furthermore since the cover thread assist member 114 is silver soldered to the spreader 106 it is secured thereto and requires not adjustments.

Referring now to FIGS. 5*d* and 5*e*, the presser foot 76 includes a shank 120 and a bottom portion 122 which is mounted on the shank 120 for pivoting about a horizontal pivot axis. The front end of the presser foot bottom portion 122 is inclined and includes a slot 124 that receives the mounting edge of a presser foot keel 126.

The throat plate 130 depicted in FIG. 5*f* has a plurality of feed dog openings 132 and a set of needle openings 134. The throat plate 130 is set into the work supporting surface 66 and is secured thereto by screws 136 that extend through countersunk holes 138 formed in the throat plate 130.

The operation of the spreader 106 and cover thread assist member 114 will be explained with reference to FIGS. 6–9. FIGS. 6, 7, 8, and 9 are a series of views showing the progressive locations of spreader 106 and the cover thread assist member 114 as the cover thread 60 is cast along the upper surface of the work material and interlocked with the needle threads 18 and 20. Needles 78 and 80 are shown to illustrate their location relative to the cover thread 60.

Figure 6:
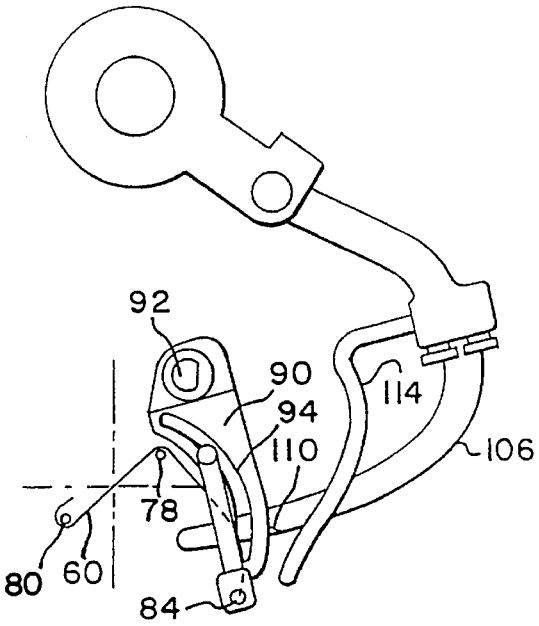
FIG. 6 is a plan view of the start of forward motion of the spreader.

FIG. 6 shows the spreader 106 at its extreme right position when it is about to start its motion to the left. At this point in the cycle, the needle bar 68 is at the bottom of its stroke and the cover thread 60 extends up from right needle 78, across the front edge of spreader 106, through the arcuate shaped slot 94 in the cover thread guide 90, through the cover thread eyelet 84 and from there to its source. The end of the cover thread 60 that extends to its source is referred to as the free end of the cover thread 60. The other end of the cover thread 60 is a part of the previously formed cover stitch and thus is not free. The eyelet 84 constrains thread 60 to the end of arcuate shaped slot 94 located at the free end of cover thread guide 90.

Figure 7:
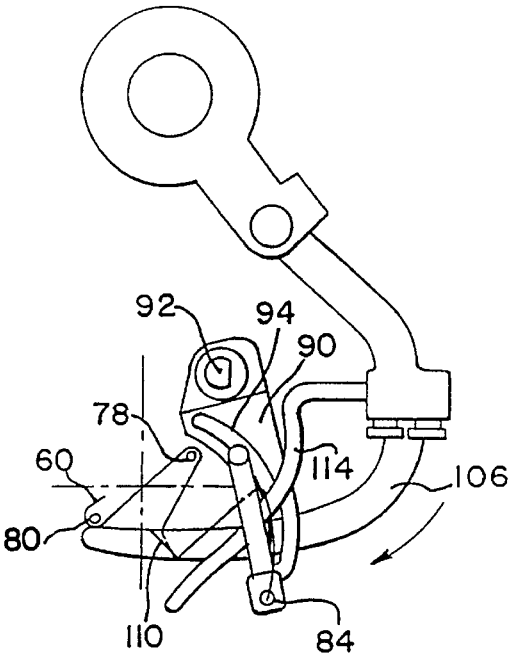
FIG. 7 is a plan view of the middle of forward motion of the spreader.

FIG. 7 shows the spreader 106 in the middle of its forward motion and moving to the left as shown by the directional arrow. At this point in the cycle the needle bar 68 is rising and is located between the bottom and top of its stroke. From the position in FIG. 6, the cover thread 60 has slid along the rear edge of spreader 106 and has encountered notch 110. Notch 110 catches cover thread 60 and holds it from further movement along the edge of spreader 106. After cover thread 60 encounters thread carrying notch 110, further movement to the left by spreader 106 causes the cover thread 60 to be pulled to the left. At this stage of the cycle, cover thread assist member 114 has also encountered cover thread 60. The cover thread assist member 114 causes the spreader to slide along the arcuate shaped slot 94, moving thread 60 toward the rear end of slot 94. In FIGS. 5 through 9 the cover thread assist member 114 is adjustably connected to the spreader 106 by set screws rather than being fixed thereto by silver solder as is illustrated in FIG. 5*c*.

Figure 8:
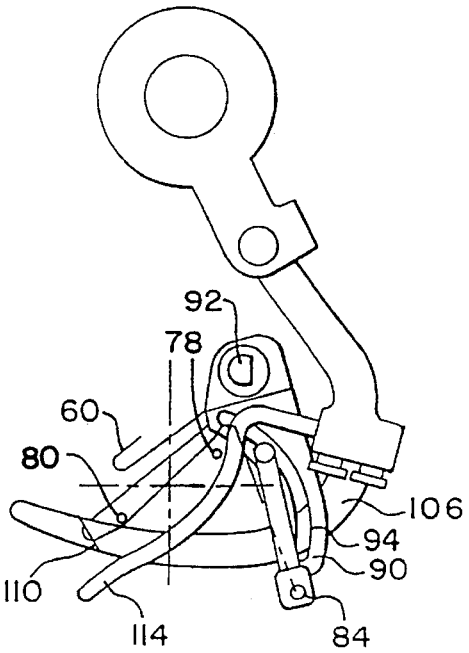
FIG. 8 is a plan view of the end of forward motion of the spreader.

FIG. 8 shows the spreader 106 at the end of its forward motion and at its extreme left position. At this point in the cycle the needle bar 68 is at the top of its stroke. The cover thread 60 remains in contact with the thread carrying notch 110 of the spreader 106 and the cover thread assist member 114 has caused the cover thread 60 to move past or forward of the tip of the right needle 78. As the needle bar 168 moved up from its position in FIG. 7, thread 60 passed under the point of needle 78 while in engagement with the front surface of needle 80. The thread 60 was free to move in this manner because the point for needle 78 is at a higher elevation than the point for needle 80. This movement of the thread 60 beneath needle 78 is caused by the action of the cover thread assist member 114 which engages cover thread 60 causing it to move toward the extremity of arcuate shaped slot 94. Immediately after the needles 78 and 80 reach the top of their cycle they reverse direction, and needle 80 penetrates the work material on one side of thread 60 and needle 78 penetrates the work material on the opposite side thereof. Needle 80 pierces the fabric first and prevents the thread 60 from being moved past needle 80 to a location on its forward side.

Figure 9:
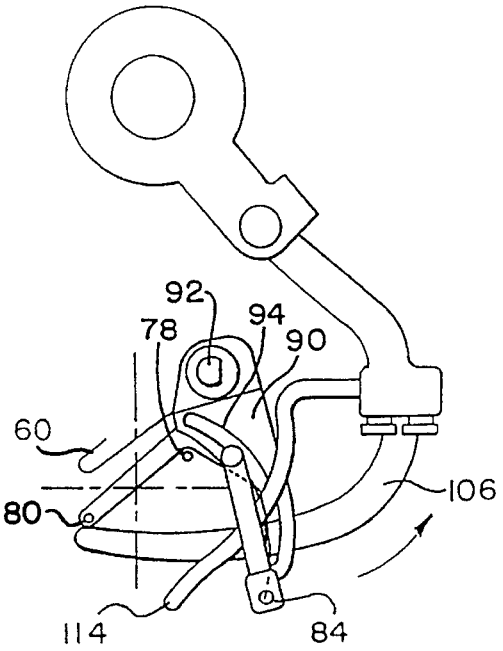
FIG. 9 is a plan view of the middle of the return motion of the spreader.

FIG. 9 shows the spreader in the middle of its return motion and moving to the right, as represented by the directional arrow. Here the needle bar 68 is moving down. When the spreader 106 reverses its direction the thread 60 is released from the notch 110. As shown in FIG. 9, thread 60 extends from around needle 78 upwardly through the arcuate shaped slot 94, over the left or rear surface of the cover thread assist member 114, and through the cover thread eyelet 84. As the cover thread assist member 114 sweeps to the right, it engages the thread 60 and allows it to slide along the edge of the arcuate shaped slot. 94 toward its terminal end, while motion is caused by the eyelet 84. When the spreader 106 reaches its extreme right position (FIG. 6) the thread 60 will have slid off the terminal end of the cover thread assist member 114, and the spreader components will have completed a cycle and will have returned to the positions shown in FIG. 6.

While the invention has heretofore been described in detail with particular reference to illustrated apparatus and seams, it is to be understood that variations, modifications and the use of equivalent mechanisms can be effected without departing from the spirit and scope of this invention. It is, therefore, intended that such changes and modifications be covered by the following claims.

What is claimed is:

1. A stitch forming mechanism for forming a flat seam in a workpiece formed of multi-layers of material comprising:

two needles reciprocating in a vertical plane and each carrying a needle thread, a throat plate having a work supporting surface lying in a horizontal plane and having openings for passage of said needles therethrough, two loopers disposed beneath said throat plate for cooperation with said needles to form two parallel rows of stitches, each looper carrying a looper thread, a spreader operating above said throat plate for casting a cover thread into loops that lay on opposite sides of said two needles when said needles penetrate said workpiece, and a cover thread assist member connected to a mid portion of said spreader, and cooperating with said spreader to form said cover thread loops in a configuration for penetration, on both sides of said cover thread, by said two reciprocating needles.

2. The invention as set forth in claim 1 wherein said cover thread assist member is constructed of a hardened wire that is connected to said spreader by silver solder.

3. The invention as set forth in claim 2 wherein said hardened wire has a diameter of about 0.05 inches.

4. The invention as set forth in claim 1 in which said stitch forming mechanism further includes a thread guide plate fixed in a position closely overlying said spreader, and a thread eyelet mounted above said thread guide plate for movement with said needles vertically toward and from said thread guide plate, said thread guide plate having an arcuate shaped slot formed therein, said cover thread extending downwardly through said eyelet, through said arcuate shaped slot, across the path of said spreader and then down to the previous stitch, the combined motions of said spreader, said cover thread assist member and said eyelet relative to said arcuate shaped slot causes said cover thread to slide between positions at opposite ends of said arcuate shaped slot to thus direct said cover thread to follow a serpentine path between said two needles.

5. The invention as set forth in claim 4 wherein said cover thread assist member is constructed of a hardened wire that is connected to said spreader by silver solder.

6. The invention as set forth in claim 5 wherein said hardened wire has a diameter of about 0.05 inches.

7. A method of forming a stitch along and over the raw edge of a first workpiece that is laying in overlapped relationship to a second workpiece comprising the steps of:

passing a first needle thread through the workpieces at points spaced along a line substantially parallel to said raw edge to form a first series of thread loops;

passing a second needle thread through the second workpiece along the raw edge of the first workpiece and parallel to said first needle thread to form a second series of thread loops, said second needle leading said first needle and it's tip being elevated relative to the tip of said first needle such that said second needle penetrates the workpiece after penetration by said first needle;

interlocking a first looper thread through said first series of thread loops;

interlocking a second looper thread through said second series of thread loops; and laying a cover thread over the top surface of the workpiece such that said cover thread interlocks with each stitch formed by said first and second needle threads, the end of said cover thread that is not interlocked in stitches already formed being referred to as it's free end, wherein the invention comprises the steps of:

(a) oscillating a spreader that has a free end and a mid portion through the stitch forming area during each stitch cycle, said spreader having a notch formed in said free end and a cover thread assist member connected to said mid portion, (b) engaging said cover thread with said spreader notch such that a loop is formed and moved to the area below said first needle;

(c) passing said first needle thread through said loop;

(d) engaging said cover thread with said cover thread assist member causing the free end of said cover thread to be carried toward and forward of said second needle such that said second needle penetrates the workpiece behind the cover thread.

8. A sewing machine for producing a stitch comprising two rows of closely and equally spaced stitches, each row of stitches formed from a needle thread and a looper thread, and wherein the mechanism for producing this stitch includes:

a reciprocating needle bar;

a throat plate having feed dog openings formed therein;

a feed dog including material engaging portions adapted to extend through said feed dog openings to advance the material in the direction of material feed;

a needle head mounting two needles, said two needles laying in a vertical plane and the point of the right needle being at a higher elevation than the corresponding point of the left needle;

said needle head being secured to said needle bar such that said vertical plane of said needle head is at an acute angle to the direction of material feed;

a looper rocker, mounted to pivot about an axis that is parallel to said direction of material feed, said looper rocker carrying two loopers, each arranged to cooperate with one of said needles and each having a looper point;

the looper point, of the looper arranged to cooperated with the left needle, being spaced from the looper point of the looper arranged to cooperate with the right needle, by an amount corresponding to the spacing between the left and right needles; the point of the looper arranged to cooperate with the right needle is located in the vertical direction further from the looper rocker axis than the points of the loopers arranged to cooperate with the left needle;

a spreader, having a notch formed at its free end and a cover thread assist member connected to a mid portion of the spreader, arranged to oscillate through the stitch forming area and contact and control a cover thread causing it to interlock with each stitch formed by said first and second needle threads.

9. The invention as set forth in claim 8 wherein the point of the looper that is arranged to cooperate with the right needle is elevated about ⅛ of an inch above the looper rocker axis than is the point of the loopers that is arranged to cooperate with the left needle.

10. The invention as set forth in claim 8 wherein said cover thread assist member is constructed of a hardened wire that is connected to said spreader by silver solder.

11. The invention as set forth in claim 10 wherein said hardened wire has a diameter of about 0.05 inches.

12. A sewing machine for producing a stitch comprising, two rows of closely and equally spaced stitches, each row of stitches being formed from a needle thread and a looper thread; and a cover thread interlaced with the two rows of stitches; wherein the mechanism for producing this stitch includes:

a reciprocating needle bar;

a throat plate having feed dog openings formed therein;

a feed dog including material engaging portions adapted to extend through said feed dog openings to advance the material in the direction of material feed;

a needle head mounting two needles, said two needles laying in a vertical plane and the point of the right needle being at a higher elevation than the corresponding point of the left needle;

said needle head being secured to said needle bar such that said vertical plane of said needle head is at an acute angle to the direction of material feed;

a looper rocker, mounted to pivot about an axis that is parallel to said direction of material feed, said looper rocker carrying two loopers, each arranged to cooperated with one of said needles and each having a looper point;

the looper point, of the looper arranged to cooperated with the left needle, spaced from the looper point of the looper arranged to cooperate with the right needle, by an amount corresponding to the spacing between the left and right needles; and oscillating spreader mechanism, including a cover thread assist member that is connected to said oscillating spreader mechanism at a mid portion thereof, for assisting in casting said cover thread such that it is interwoven by the stitches formed by said two needles.

13. The invention as set forth in claim 12 wherein said cover thread assist member is constructed of a hardened wire that is connected to said spreader by silver solder.

14. The invention as set forth in claim 13 wherein said hardened wire has a diameter of about 0.05 inches.

15. The invention as set forth in claim 12 wherein said left and right row of stitches are each about ⅜ of an inch apart.

16. The invention as set forth in claim 12 wherein the point of the looper arranged to cooperate with the right needle is about ⅛ of an inch in the vertical direction further from the looper rocker axis than is the point of the loopers arranged to cooperate with the left needle.

17. The invention as set forth in claim 13 wherein the point of the looper arranged to cooperate with the right needle is about ⅛ of an inch in the vertical direction further from the looper rocker axis than is the point of the loopers arranged to cooperate with the left needle.

18. The invention as set forth in claim 16 wherein said cover thread assist member is constructed of a hardened wire that is connected to said spreader by silver solder.

19. The invention as set forth in claim 16 wherein said hardened wire has a diameter of about 0.05 inches.

20. The invention as set forth in claim 18 wherein said left and right row of stitches are each about ⅜ of an inch apart.

21. The invention as set forth in claim 1 wherein said cover thread assist member is constructed of a hardened wire that is adjustably connected to said spreader by screws.

22. The invention as set forth in claim 8 wherein said cover thread assist member is constructed of a hardened wire that is adjustably connected to said spreader by screws.

23. The invention as set forth in claim 12 wherein said cover thread assist member is constructed of a hardened wire that is adjustably connected to said spreader by screws.

24. A spreader mechanism for casting cover thread loops for use in a sewing machine that produces a stitch that includes a cover thread, said spreader mechanism comprising:

an oscillating member having a generally arcuate shape;

said oscillating member including a mid portion and a free end;

a notch formed in said free end of said oscillating member; and a cover thread assist member connected to said mid portion of said oscillating member for cooperating with said oscillating member to form said cover thread loops.

25. The invention as set forth in claim 24 wherein said cover thread assist member is constructed of a hardened wire that is connected to said oscillating member by silver solder.

26. The invention as set forth in claim 24 wherein said cover thread assist member is constructed of a hardened wire that is adjustably connected to said oscillating member by screws.

* * * * *

UNITED STATES PATENT AND TRADEMARK OFFICE

CERTIFICATE OF CORRECTION

PATENT NO. : 5,517,933

DATED : May 21, 1996

INVENTOR(S) : James M. Karaba, Jr.

It is certified that error appears in the above-indentified patent and that said Letters Patent is hereby corrected as shown below:

Column 7:

In claim 7, line 11, delete "it's" and substitute --its--.

In claim 7, column 8, line 3, delete "it's" and substitute --its--.

In claim 7, column 8, line 9, after "portion" delete "," and substitute --;--.

In claim 8, line 22, deleted "cooperated" and substitute --cooperate--.

In claim 8, line 26, please begin a new paragraph at the first occurrence of "the".

In claim 12, column 9, lines 19 and 20, delete "cooperated" and substitute --cooperate--.

UNITED STATES PATENT AND TRADEMARK OFFICE

CERTIFICATE OF CORRECTION

PATENT NO. : 5,517,933

DATED : May 21, 1996

INVENTOR(S) : James M. Karaba, Jr.

It is certified that error appears in the above-indentified patent and that said Letters Patent is hereby corrected as shown below:

In claim 12, column 9, line 23, delete "cooperated" and substitute --cooperate--.

Signed and Sealed this

Ninth Day of September, 1997

*Attest:*

*Attesting Officer*

BRUCE LEHMAN

*Commissioner of Patents and Trademarks*